US005799443A

United States Patent [19]

Koeniguer

[11] Patent Number: 5,799,443

[45] Date of Patent: Sep. 1, 1998

[54] DOOR AND DOOR FRAME PROTECTOR ASSEMBLY

[76] Inventor: Charles D. Koeniguer, 4504 Steven Dr., Edmond, Okla. 73013

[21] Appl. No.: 663,458

[22] Filed: Jun. 13, 1996

[51] Int. Cl.[6] ..... E05D 11/00

[52] U.S. Cl. ..... 49/383; 16/137

[58] Field of Search ..... 49/383, 384; 16/221, 16/225, 250, 137; 160/40; 52/211, 212, 204.53, 204.54

[56] References Cited

U.S. PATENT DOCUMENTS

| | | | |
|---|---|---|---|
| 2,320,991 | 6/1943 | White | 49/462 |
| 2,837,787 | 6/1958 | Wright | 49/462 |
| 3,319,697 | 5/1967 | Krohn | 16/250 |
| 3,391,509 | 7/1968 | Fruman | 52/211 |
| 4,040,142 | 8/1977 | Ippolito | 49/383 |
| 4,261,140 | 4/1981 | McLean | 49/383 |
| 4,344,253 | 8/1982 | Stiles | 49/462 |
| 4,372,364 | 2/1983 | Katz | 150/52 R |
| 4,768,320 | 9/1988 | Weller | 52/211 |
| 4,845,892 | 7/1989 | Pinto | 49/383 |
| 4,878,267 | 11/1989 | Roach et al. | 16/250 |
| 5,092,077 | 3/1992 | Teinturier-Milgram | 160/40 |
| 5,103,593 | 4/1992 | McNaughton | 49/460 |
| 5,203,130 | 4/1993 | Freelove | 52/211 |
| 5,255,727 | 10/1993 | Saruwatari et al. | 150/154 |
| 5,351,733 | 10/1994 | Ullman | 150/154 |
| 5,412,909 | 5/1995 | Wu | 49/505 |

*Primary Examiner*—Daniel P. Stodola
*Assistant Examiner*—Curtis Cohen
*Attorney, Agent, or Firm*—McAfee & Taft

[57] ABSTRACT

A temporarily installed resilient, shock-absorbent cover to protect the vulnerable parts of doors and door frames, as well as the frames of archways and the furniture that passes therethrough during the process of moving is disclosed. The cover includes a hinge side frame cover temporarily secured to the door. The hinge side frame cover shields the face of the door frame, and also shields a portion of the door. A latch side frame cover protects the latch side portion of the door frame. The latch side frame cover has an angular U shape which covers the forward, inner and rear face of the door frame. The cover is held in place by upper and lower retainer clips which are permanently attached thereto. The clips apply pressure to the wall creating friction to hold the cover in position. In archways where no door is present, both sides of the opening are covered with latch side frame covers.

11 Claims, 4 Drawing Sheets

DOOR AND DOOR FRAME PROTECTOR ASSEMBLY

BACKGROUND OF THE INVENTION

This invention relates to protective door frame covers, specifically those used to temporarily cover residential and commercial, interior and exterior doors and door frames.

DESCRIPTION OF THE PRIOR ART

Since 1945, America has become an increasingly mobile society. Current government estimates show that one in five Americans move each year. The moving process—whether do-it-yourself or commercially hired—have many procedures in common. One of these commonalities is that items both large and small must pass through numerous doorways and narrow archways while in the process of being moved from one location to another. This movement creates many opportunities for the items being moved to come in contact with the door frames installed around the doorway opening as well as the casings around archway openings where no door is present. Contact of furniture and other items with the periphery of these openings causes damage to the furniture and scarring of the doors, door frames and the casings in archways. In commercially hired moves this damage results in thousands of insurance claims being filed each year.

One type of door protector has been proposed in U. S. Pat. No. 4,372,364 to Katz, issued Feb. 8, 1983. Katz describes a canvas bag-like device filled with cotton batting which hangs over the top of a main entrance door. This device provides no protection to the most vulnerable part of the doorway—the door frame on either side. In addition, no protection at all is provided for the casings of archways where no door is installed. The canvas sides and cotton filling described in the Katz patent provide minimal protection from the impact of furniture and hard-sided boxes.

Other door protective devices are disclosed in U. S. Pat. Nos. 5,103,593 to McNaughton, 5,351,733 to Uhlman and 5,255,727 to Saruwatari et al. None of those patents disclose apparatus which can be used to protect not only doors but also door frames. U. S. Pat. No. 5,412,909 to Wu discloses plastic casing to permanently cover an existing door frame. Nothing therein nor in any of the other patents discloses a removable protector which will protect a door and a door frame while furniture and/or other articles are being moved through the doorway opening.

SUMMARY OF THE INVENTION

The door frame protector of the present invention comprises a hinge side frame cover for protecting the hinge side portion of the door frame. The door frame typically installed around the periphery of a doorway opening has a forward or front face, an inner face and a rear face. The door frame has a height, as does a door hung in the doorway opening.

The hinge side frame cover of the present invention has a length extending between its upper and lower ends. The periphery of the hinge side frame cover spans from the forward face of the door frame at a hinge side portion thereof to a forward face of the door when the door is in an open position for passage through the doorway. Thus, the hinge side frame cover covers the forward face of the frame and a portion of the forward face of the door along the length of the hinge side frame cover. The hinge side frame cover is vertically adjustable along the height of the frame so that a desired area of the hinge side portion of the door frame and the door may be covered.

The hinge side frame cover may include a door cover panel extending from a hinge edge of the door in a direction toward a latch edge of the door. The hinge side frame cover further includes a frame cover panel which covers the forward face of the hinge side portion of the door frame, and a center panel which spans between and connects the frame cover panel to the door cover panel.

The invention includes a door catch which is attached to an inner surface of the hinge side frame cover and which surrounds the hinge edge of the door. A door clip which nests over the latch edge of the door is also included. A tensioning means is connected to the door clip and the hinge side frame cover. The tensioning means will pull the door catch and door clip toward one another, so that the door catch is forced against the hinge edge of the door and the door clip is forced against the latch edge, thus holding the hinge side frame cover in place.

The door frame protector of the present invention may further include a latch side frame cover. The latch side frame cover may also be referred to as an archway frame cover. The latch side cover includes an upper end and a lower end with a length extending therebetween. The periphery of the latch side cover spans from a forward face of a latch side portion of the door frame to a rear side of the latch side portion of the door frame. Thus, the latch side frame cover covers the forward face, the rear face and an inner face of the latch side portion of the door frame along the length of the latch side frame cover.

A means for removably securing the latch side frame cover to the door frame is also included. The means for removably securing may include an upper retainer clip disposed at the upper end of the latch side frame cover and a lower retainer clip disposed at a lower end of the latch side frame cover. The upper and lower retainer clips circumscribe the door frame and include inwardly directed tabs which will engage a wall to which the door frame is attached, thereby holding the latch side cover in place. The upper and lower retainer clips are flexible so that they can be opened and the hinge side cover moved up or down and temporarily secured in a desired location. Thus, the latch side frame cover is vertically adjustable along the height of the door frame. The latch side frame cover may include a front panel which covers the forward face of the door frame, a rear panel which covers the rear face of the door frame and a center panel which connects the front panel and the rear panel and which covers the inner face of the door frame.

Accordingly, several objects and advantages of the current invention are:

(a) to provide an impact resilient cover which clads the door frame and part of the door on one side and the door frame on the other;

(b) to provide a cover that can be quickly and easily removed and installed in another location;

(c) to provide a cover that is fully and quickly adjustable to various door widths;

(d) to provide a cover that is fully and quickly vertically adjustable regardless of hinge position;

(e) to provide protective covers that are cheaply and easily manufactured.

Further objects and advantages will become apparent from consideration of the drawings and ensuing description.

BRIEF DESCRIPTION OF THE DRAWINGS

FIG. 6 is a cross-sectional view of the hinge side frame cover. The door and door frame are not shown.

DESCRIPTION OF A PREFERRED EMBODIMENT

Figure 1:
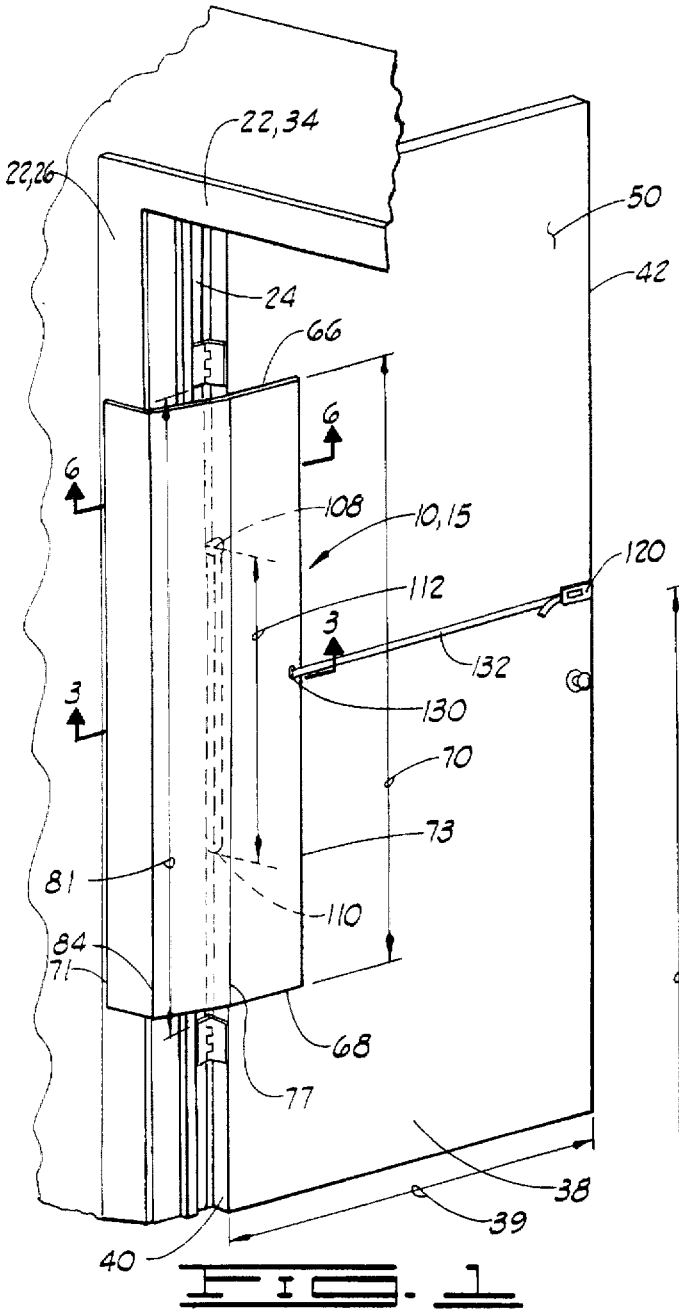
FIG. 1 is a perspective view of the hinge side frame cover of the door frame protector assembly.
Figure 2:
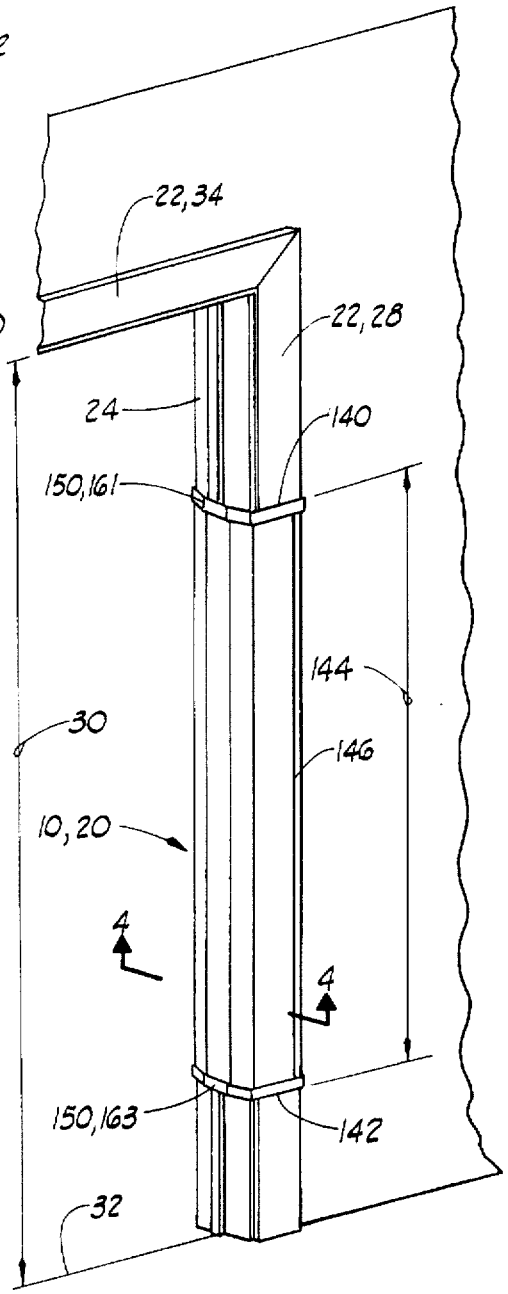
FIG. 2 is a perspective view of the latch side frame cover of the door frame protector assembly.

Referring now to the drawings and more particularly to FIGS. 1 and 2, a door frame protector assembly is shown and generally designated by the numeral 10. Door frame protector 10 may include a hinge side frame cover 15 and a latch side frame cover 20. Hinge side frame cover 15 and latch side frame cover 20 are preferably made from a resilient shock-absorbent material, such as molded expanded polystyrene board. However, both covers may be made from any resilient shock-absorbent material such as, but not limited to, extruded vinyl, polypropylene, compressed paper fibers and cardboard. The door frame protector will protect a door frame 22 which is installed around the periphery of a doorway opening 24. The door frame comprises a hinge side portion 26 and a latch side portion 28. Door frame 22 has a height 30 extending from a floor surface 32 upwardly to a top of the doorway opening 24. Door frame 22 has a top portion 34 which extends across the top of the doorway opening and connects the hinge side portion 26 and latch side portion 28 of the door frame. Thus, doorway frame 22 extends around the entire periphery of doorway opening 24.

Figures 3, 4:
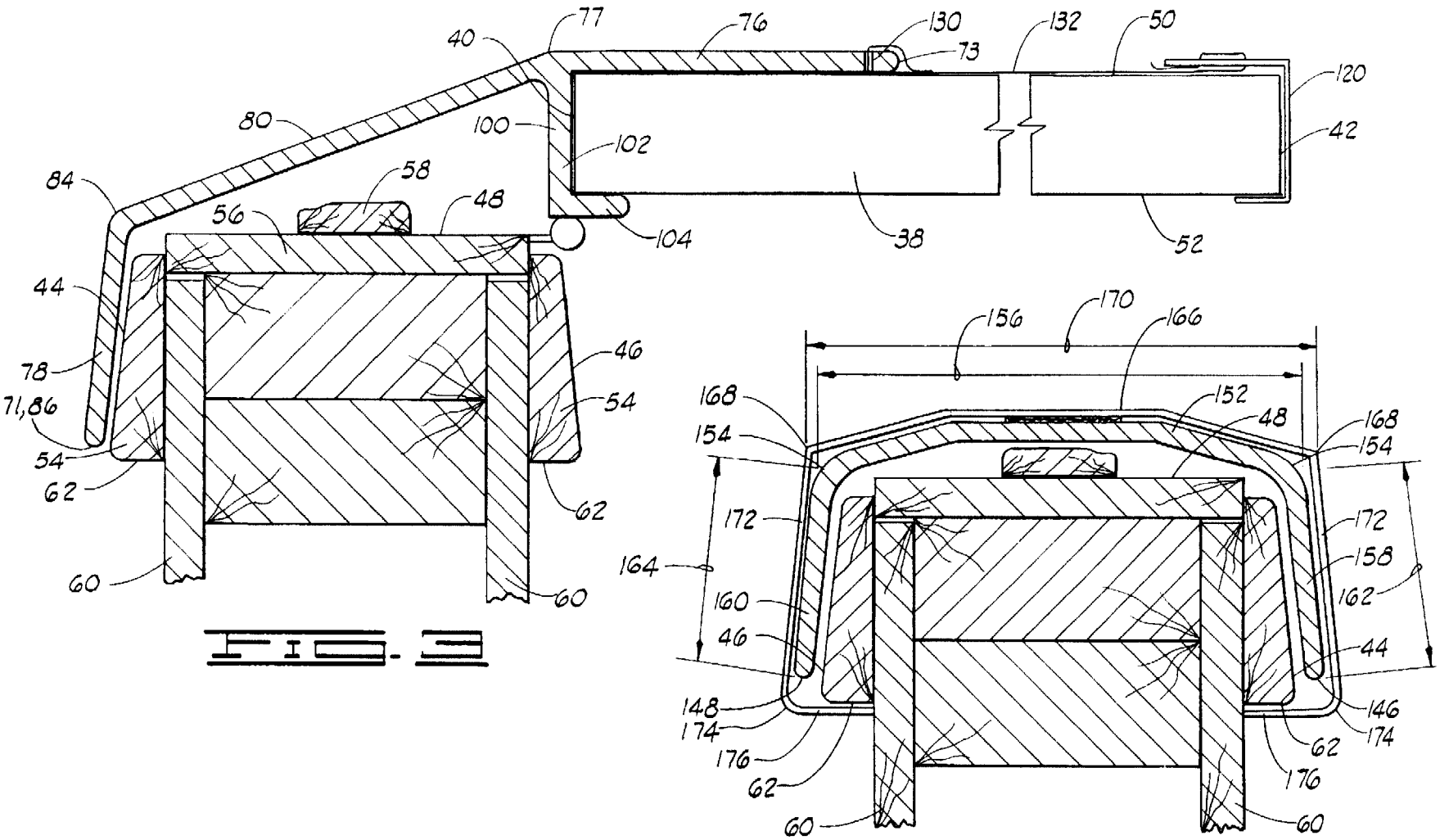
FIG. 3 is a cross-sectional view in detail of the portion indicated by line 3—3 in FIG. 1.
FIG. 4 is a cross-sectional view in detail of the portion indicated by line 4—4 in FIG. 2.

A door 38 is hingedly attached to the hinge side portion of door frame 22 in a manner known in the art. The door has a width 39, a hinge edge 40 and a latch edge 42. As better seen in FIGS. 3 and 4, door frame 22 has a forward or front face 44, a rear face 46 and an inner face 48. Likewise, door 38 has a front face 50 and a rear face 52. The door frame may be comprised of door trim or casing 54 and a door jamb 56. Door frame 22 may also include a door stop 58 attached to jamb 56. Front and rear faces 44 and 46 respectively of the frame may be defined on casing 54, while inner face 48 is defined on jamb 56 and stop 58. As shown in FIGS. 3 and 4, casing 54 extends back from jamb 56 and the door opening on a wall 60 and terminates on wall 60 at an edge 62.

Referring to FIG. 1, hinge side frame cover 15 has a top or upper end 66, a bottom or lower end 68 and has a length 70 therebetween. Hinge side frame cover 15 further includes an inner surface 72, an outer surface 74, and side, or outer edges 71 and 73. As shown in FIG. 1, the peripheral distance between edges 71 and 73 is such that hinge side frame cover 15 spans from the forward face 44 of hinge side portion 26 past hinge edge 40 of the door to the forward face 50 of door 38 when door 38 is in an open position for passage through doorway opening 24. Thus, hinge side frame cover 15 covers forward face 44 of hinge side portion 26 and a portion of the forward face of door 38, and also covers and protects inner surface 48 of hinge side portion 26 along the length 70 of the hinge side frame cover when door 38 is in an open position for passage therethrough, as shown in FIG. 3. The door may be open more, or less, than as depicted in FIG. 3, and the frame cover will still cover and protect the door and door frame, since the cover is resilient and somewhat flexible, and, as explained more fully herein, is temporarily secured to the door. The length 70 is sufficient to cover the distance 81 between the hinges on a two hinge door.

The hinge side frame cover may thus be comprised of a door cover panel 76, a frame cover panel 78 and a center or connecting panel 80. Door cover panel 76 has a first edge 77 and extends from hinge edge 40 of door 38 in a direction toward latch edge 42. Door cover panel 76 terminates at outer edge 73 of the hinge side frame cover. The door cover panel has a width 82 that is preferably less than the width 39 of door 38. Thus, door cover panel 76 covers a portion of forward face 50 of door 38 when hinge side frame cover 15 is temporarily secured at the desired position along the height of door frame 22.

As shown in the cross section in FIG. 3, frame cover panel 78 has a first edge 84 and a second edge 86. Second edge 86 corresponds with edge 71 of hinge side frame cover 15. Frame cover panel 78 has a width 88 sufficient to cover almost all, and may cover entirely front face 44 of door frame 22 along the length 70 of hinge side frame cover 15.

Center panel 80 spans between and connects door cover panel 76 and frame cover panel 78. Specifically, center panel 80 is connected to first edge 84 of frame cover panel 78 and first edge 77 of door cover panel 76. Center panel 80 thus covers inner surface 48 of frame 22 when hinge side frame cover 15 is temporarily secured in position.

A door catch 100, as better seen in FIGS. 3 and 6, extends from inner surface 72 of hinge side frame cover 15. Door catch 100 may comprise a first leg 102 extending from inner surface 72 in a direction substantially parallel to hinge edge 40 of door 38, and a second leg 104 attached to an outer end 106 of first leg 102. Second leg 104 extends from leg 102 in a direction toward latch edge 42 of door 38. Door catch 100 thus surrounds hinge edge 40.

Door catch 100 has an upper end 108 and a lower end 110 with a length 112 defined therebetween. Door catch 100 is located between the two hinges of a two-hinged door. Length 112 is of lesser magnitude than overall length 70 of hinge side frame cover and is less than the distance 81 between the door hinges so that the door catch 100 can move vertically up or down between the hinges. Thus, the hinge side frame cover 15 is vertically adjustable and can be located at a desired position along the height of the door frame.

Figure 7:
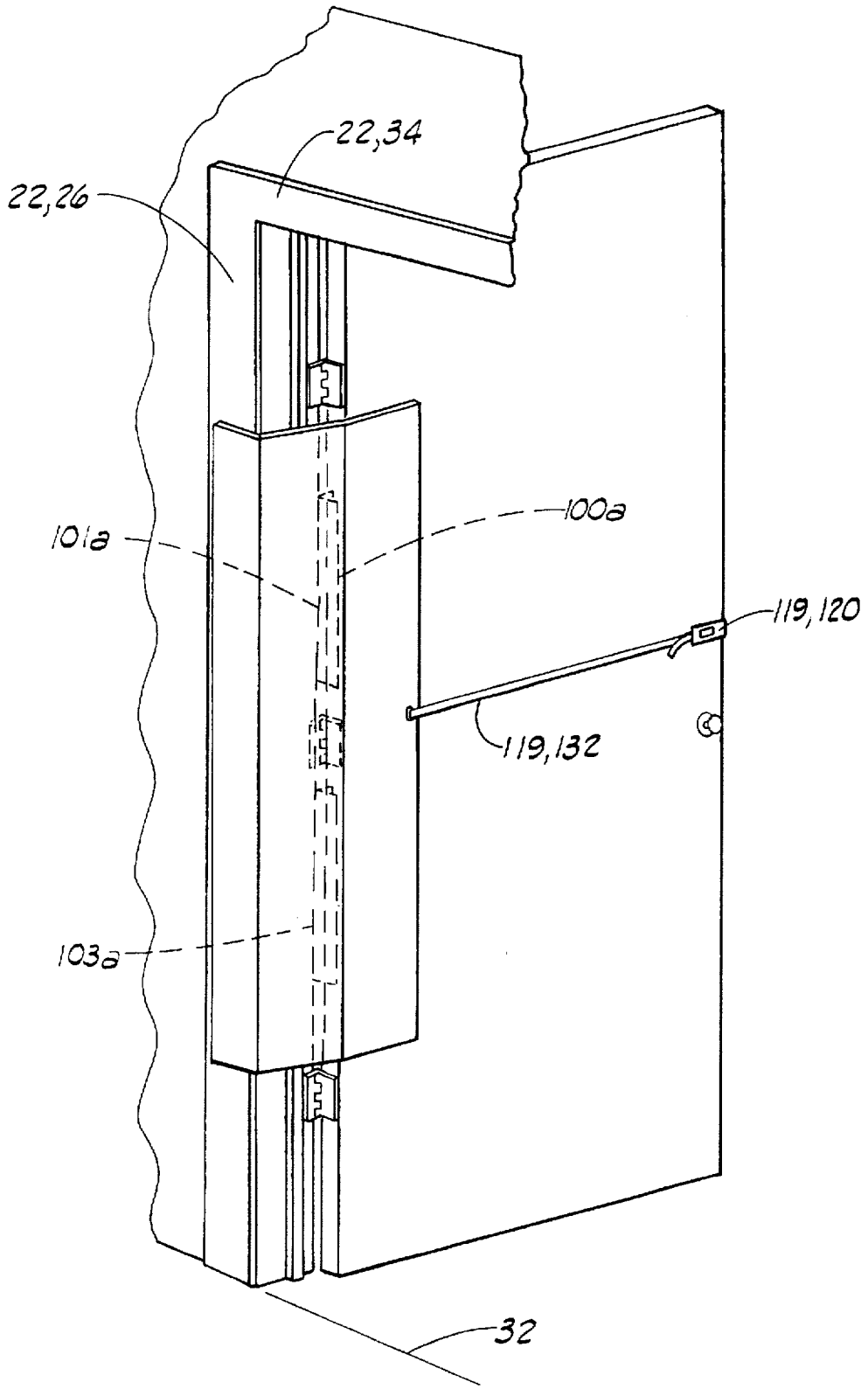
FIG. 7 shows an alternate embodiment of the hinge side frame cover of the present invention.

In another embodiment shown in FIG. 7, a hinge side frame cover may include a door catch 100*a* having an upper segment 101*a* and a lower segment 103*a*. Segment 101*a* fits, with ample clearance, between the upper and middle hinge of a three hinge door, while segment 103*a* fits between the middle and lower hinge, so that the present invention can be used with and is vertically adjustable along a door frame in a doorway having a three hinge door. As will be understood by those in the art, the hinge side frame cover of the present invention may include any number of door catch segments to accommodate door frames having any number of hinges.

Figure 5:
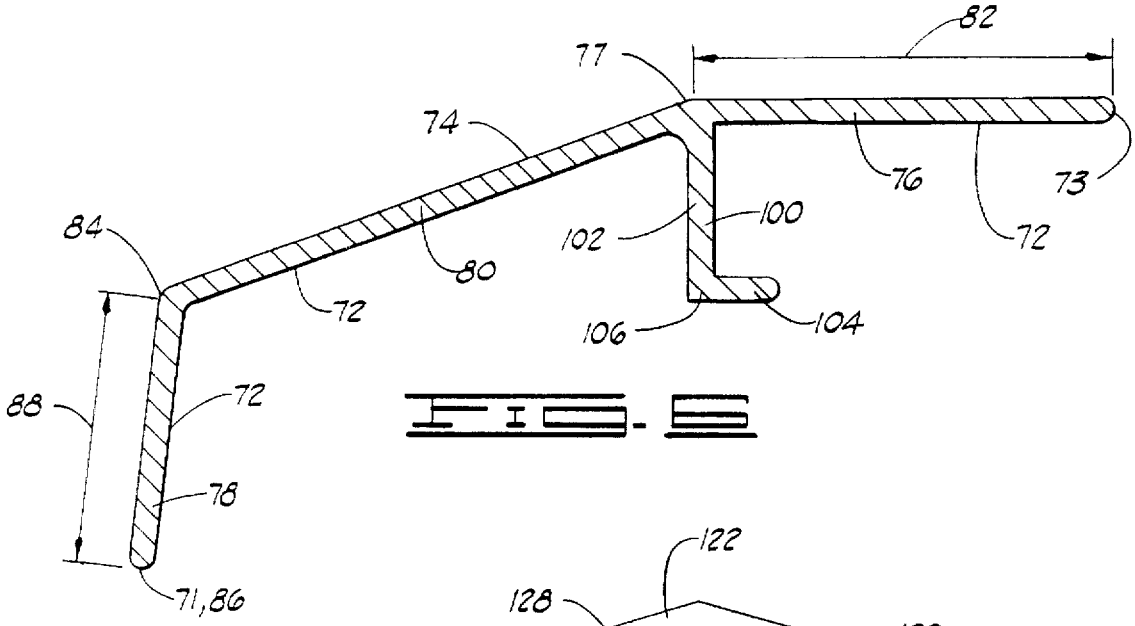
FIG. 5 is a perspective view of a typical door clip.
Figure 5:
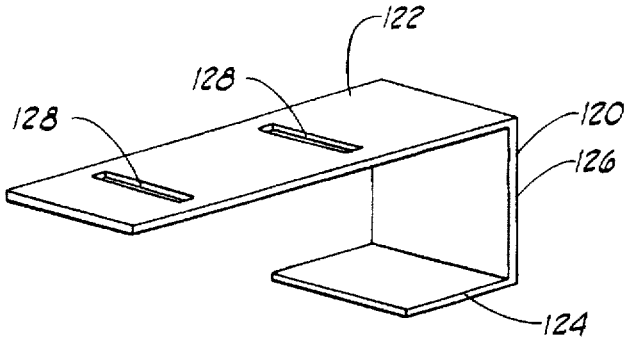

A means 119 for removably securing the hinged side frame cover in place along the height of door frame 22 is also included. Means for securing may include a door clip 120. As shown in FIG. 5, door clip 120 may be generally J-shaped and will nest around door 38 at latch edge 42. Thus, door clip 120 includes first leg 122, second leg 124, and connecting member 126. First and second legs 122 and 124 are preferably parallel and are connected by connecting member 126 which is preferably perpendicular to first and second legs 122 and 124. Door clip 120 is positioned so that first and second legs 122 and 124, respectively, extend from latch edge 42 of door 38 toward hinge edge 40. First leg 122 has openings 128 defined therein. Likewise, as seen in FIGS. 1 and 3, door cover panel 76 of hinge side frame cover 15 has an opening 130 defined therein. Means for securing 119 may also include a tensioning means 132, which may comprise an elastic strap connected to openings 128 in door catch 120 and opening 130 in door cover panel 76.

In operation, the hinge side frame cover 15 is positioned so that door catch 100 surrounds hinge edge 40 of door 38 and J-shaped door clip 120 is positioned to nest around latch edge 42. The tension in tensioning means 132 pulls door catch 100 and door clip 120 towards one another. Thus, door clip 120 will be pulled against latch edge 42 and door catch 100 will be pulled against hinge edge 40 thereby temporarily and removably securing hinge side frame cover 15 in position along the height of frame 22. Because length 112 of door catch 100 is less than the distance between the two hinges on a two-hinged door, hinge side frame cover 15, as previously stated, is vertically adjustable so that it can be located at any desired position along the height of the door frame and the door. To vertically adjust hinge side frame cover 15, cover 15 and door clip 120 are moved up or down until the desired location is reached.

Latch side frame cover 20, which may also be referred to as an archway frame cover, may comprise a flexible frame cover having an upper end 140, a lower end 142 and a length 144 defined therebetween. Length 144 is preferably approximately equivalent to length 70 of hinge side frame cover 15. As shown in the cross section in FIG. 4, latch side cover 20 has a generally U-shaped profile, and thus has a first outer edge 146 and a second outer edge 148. The frame cover extends peripherally from first outer edge 146, which is positioned at forward face 44 of the door frame, around inner face 48 and terminates at second outer edge 148 on the rear face 46 of door frame 22. Thus, latch side frame cover 20 extends from the forward face of the door frame to the rear face of the door frame and covers the forward face, the rear face and the inner face of door frame 22 along the length 144 of latch side frame cover 20. The latch side frame cover also includes a means 150 for removably, or temporarily securing the frame cover over the latch side portion of the door frame.

Latch side frame cover may include a center panel 152 having outer edges 154. Center panel 152 has a width 156 extending between outer edges 154 sufficient to cover inner surface 48 of door frame 22. A front panel and a rear panel 158 and 160 respectively extend from edges 154 in a direction away from the doorway opening a distance sufficient to cover at least a portion of front and rear faces 44 and 46 respectively of the door frame 22 along the height thereof. Front panel terminates at edge 146 and rear panel terminates at edge 148. Front panel 158 has a width 162 sufficient to cover at least a portion of front face 44, and may completely cover front face 44, along the length of the latch side frame cover. Likewise, rear panel 160 has a width 164 sufficient to cover at least a portion of rear face 46, and may completely cover rear face 46 along the length of the latch side frame cover.

Means for securing 150 may include an upper retainer clip 161 disposed at upper end 140 and a lower retainer clip 163 disposed at lower end 142 of latch side cover 20. The retainer clips may be fixed to the latch side frame cover with adhesive, or by other means known in the art. As shown in FIGS. 2 and 4, the upper and lower retainer clips circumscribe the periphery of latch side frame cover 20 at the upper and lower ends thereof. Thus, upper and lower retainer clips 161 and 163 include a center portion 166 having outer edges 168. As depicted in FIG. 5, a width 170 of center portion 166 is slightly larger than width 156. A pair of legs 172 extend from edges 168 in a direction generally parallel to front and rear panels 158 and 160 respectively. Legs 172 terminate at ends 174 beyond first and second edges 146 and 148 of latch side frame cover 15. A pair of tabs 176 extend toward wall 60 from edges 174. Tabs 176 of the upper and lower retainer clips engage wall 60 behind door frame 22 thus securing latch side frame cover 20 in place.

The distance between tabs 176 when the retainer clips 161 and 163 are in a relaxed position will be less than the width of the wall to which the door frame is attached. The latch side frame cover is flexible so that when it is desired that latch side frame cover 20 be removably attached, clips 161 and 163 are spread apart to a width greater than the width of frame 22 and the latch side frame cover is placed over frame 22 at the desired location along the height of the door frame. Tabs 176 are then released and the pressure applied by the tabs to the wall will hold the latch side cover in place at any desired location along the height of the door frame. Thus, the latch side frame cover is vertically adjustable along the height of the door frame.

The operation of the invention is clear from the description and the drawings provided herein. The hinge side frame cover is installed by slipping the door catch 100 over the hinge edge 40 of the door as shown in FIGS. 1 and 3. Tensioning means 132 is stretched until door clip 120 nests over latch edge 42 of door 38. Both the door clip 120 and hinge side frame cover 15 may be moved up or down to any desired location. Although the embodiment shown herein depicts a two-hinged door, the door catch may be used with a three-hinged door as shown in FIG. 7 simply by providing for a two-piece door catch as shown therein.

Figure 8:
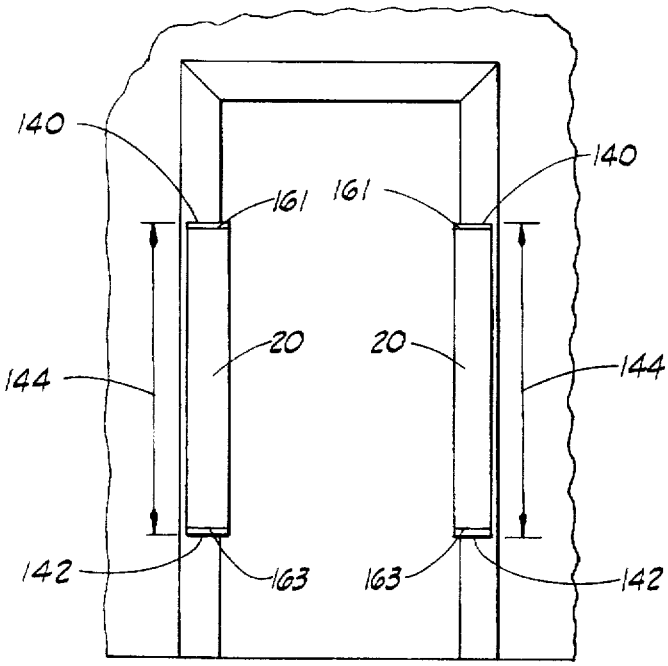
FIG. 8 shows a front view of an archway with a pair of archway frame covers.

The latch side frame cover is installed as previously described simply by spreading the retainer clips apart and installing the cover over the door frame. In archways where no door exists, such as that depicted in FIG. 8, a pair of latch side frame covers can be used so that archway frame can be protected on both sides when furniture and other articles are being carried therethrough.

It has been shown that the door frame protector of this invention provides distinct advantages over the prior art. It is understood that the foregoing description of the invention and illustrative drawings which accompany the same are presented by way of explanation only and that changes may be made by those skilled in the art without departing from the true spirit of the invention. Accordingly, any and all modifications, variations or equivalent apparatus or methods which may occur to those skilled in the art should be considered to be within the scope of the invention as defined by the appended claims.

What is claimed is:

1. A door frame protector for a door frame installed around a periphery of a doorway, said door frame having a height, said door frame protector comprising:

a hinge side frame cover for repetitive installation on and removal from a door frame for temporarily protecting a hinge side portion of said door frame, said hinge side frame cover having an upper end and a lower end and having a length extending therebetween, said hinge side frame cover being positionable to span from a forward face of said hinge side portion of said door frame to a forward face of a door hung in said doorway when said door is in an open position for passage through said doorway, so that said hinge side frame cover will cover said forward face of said frame and at least a portion of said forward face of said door along said length of said hinge side frame cover when said door is in said open position, said hinge side frame cover comprising:

a door cover panel adapted to extend from a hinge edge of said door in a direction toward a latch edge of said door so that said door cover panel will cover said at least a portion of said forward face of said door along said length of said hinge side frame cover;

a frame cover panel adapted to cover said forward face of said hinge side portion of said door frame along said length; and a center panel spanning between and connecting said frame cover panel to said door cover panel; and a door catch attached to an inner surface of said hinge side frame cover, said door catch comprising:

a first lea extending from said inner surface of said cover, said first leg adapted to be substantially parallel to said hinge edge of said door; and a second leg connected to said first leg and extending in a direction which would be toward said latch edge, so that said door catch will surround said hinge edge of said door.

2. The door frame protector of claim 1 wherein said hinge side frame cover is readily movable along said height of said door frame, said hinge side frame cover thereby being vertically adjustable so that said hinge side frame cover may be positioned to cover said door frame and said door at a desired location along said height of said door frame.

3. The door frame protector of claim 1 further comprising:

a door clip, said door clip being positionable to nest over said latch edge of said door; and tensioning means connected to said door clip and said hinge side frame cover, to pull said door catch and said door clip toward one another and to hold said hinge side cover in place along said height of said door frame.

4. The door frame protector of claim 1 further comprising means for temporarily securing said hinge side frame cover at a desired location along said height of said door frame.

5. The door frame protector of claim 1 further comprising:

a latch side frame cover, said latch side frame cover having a length and being adapted to peripherally extend from a forward face of a latch side portion of said door frame to a rear face of said latch side portion of said door frame, so that said latch side frame cover will cover said forward face, said rear face, and an inner face of said latch side portion of said door frame along said length of said hinge side frame cover; and means for temporarily securing said latch side frame cover to said door frame.

6. The door frame protector of claim 5 wherein said latch side frame cover is vertically adjustable, so that said latch side frame cover can be moved along said height of said door frame to cover a desired portion of said latch side portion of said door frame.

7. The door frame protector of claim 6, wherein said means for temporarily securing said latch side frame cover comprises:

an upper retainer clip disposed at an upper end of said latch side cover; and a lower retainer clip disposed at a lower end of said latch side cover, said upper and lower retainer clips being engagable with a wall to which said frame is attached to hold said latch side frame cover in place.

8. A door frame protector for a door frame installed around a doorway, said door frame protector comprising:

a hinge side frame cover for protecting a hinge side portion of said door frame, said hinge side frame cover having an upper end and a lower end and having a length extending therebetween and having a pair of side edges, a distance between said side edges being such that said hinge side frame cover will span from a forward face of said hinge side portion to a forward face of a door hingedly connected in said doorway when said door is in an open position to cover at least a portion of said forward face of said hinge side portion of said door frame and at least a portion of said forward face of said door; and a door catch connected to and extending from said hinge frame cover in a direction which would be toward a rear face of said door for engaging a hinge edge of said door when said hinge side frame cover is located to protect said hinge side portion of said door frame, said door catch comprising:

a first leg extending from said hinge side frame cover in a direction which would be toward said rear face of said door and a second leg connected to an outer end of said first leg, said second leg extending in a direction which would be toward a latch edge of said door.

9. A door frame protector for a door frame installed around a doorway, said door frame protector comprising:

a hinge side frame cover for Protecting a hinge side portion of said door frame, said hinge side frame cover having an upper end and a lower end and having a length extending therebetween and having a pair of side edges, a distance between said side edges being such that said hinge side frame cover will span from a forward face of said hinge side portion to a forward face of a door hingedly connected in said doorway when said door is in an open position to cover at least a portion of said forward face of said hinge side portion of said door frame and at least a portion of said forward face of said door:

a door clip for engaging a latch edge of said door; and a tensioning means connected to said door clip and said hinge side frame cover to hold said door catch and said door clip into engagement with said hinge edge and said latch edge of said door respectively, thereby holding said hinge side frame cover in place along said height of said door frame.

10. The door frame protector of claim 9 wherein said hinge side frame cover is vertically adjustable along said height of said door frame.

11. The door frame protector of claim 9 wherein said door catch is connected to an inner surface of said hinge side frame cover.

* * * * *

UNITED STATES PATENT AND TRADEMARK OFFICE

CERTIFICATE OF CORRECTION

PATENT NO. : 5,799,443

DATED : September 1, 1998

INVENTOR(S) : Charles D. Koeniguer

It is certified that error appears in the above-identified patent and that said Letters Patent is hereby corrected as shown below:

Claim 1 (column 7, line 20), delete "lea" and insert --leg-- therefor.

Claim 9, line 3 (column 8, line 35), delete "Protecting" and insert --protecting-- therefor.

Signed and Sealed this

Eighth Day of December, 1998

Bruce Lehman

*Attest:*

BRUCE LEHMAN

*Attesting Officer*

*Commissioner of Patents and Trademarks*